US008142057B2

(12) United States Patent
Roos et al.

(10) Patent No.: US 8,142,057 B2
(45) Date of Patent: Mar. 27, 2012

(54) RECESSED LED DOWNLIGHT

(75) Inventors: Scott Roos, Glenview, IL (US); Bruce Layne, Wheaton, IL (US); Matt Wnek, Elk Grove Village, IL (US)

(73) Assignee: Schneider Electric USA, Inc., Palatine, IL (US)

( * ) Notice: Subject to any disclaimer, the term of this patent is extended or adjusted under 35 U.S.C. 154(b) by 331 days.

(21) Appl. No.: 12/468,669

(22) Filed: May 19, 2009

(65) Prior Publication Data

US 2010/0296272 A1 Nov. 25, 2010

(51) Int. Cl.
*F21V 15/00* (2006.01)
*F21V 29/00* (2006.01)
*F21S 8/00* (2006.01)

(52) U.S. Cl. ..... 362/364; 362/373; 362/147

(58) Field of Classification Search ..... 362/147, 362/362, 364, 294, 373
See application file for complete search history.

(56) References Cited

U.S. PATENT DOCUMENTS

| | | | | |
|---|---|---|---|---|
| 3,518,420 | A | 6/1970 | Kripp | |
| 4,630,182 | A | 12/1986 | Moroi et al. | 362/294 |
| 5,161,871 | A * | 11/1992 | Baliozian | 362/18 |
| 5,365,145 | A | 11/1994 | Fields | 315/86 |
| 5,758,956 | A | 6/1998 | Bornhorst et al. | 362/294 |
| 5,813,752 | A | 9/1998 | Singer et al. | 362/293 |
| 6,997,583 | B2 * | 2/2006 | Broelemann | 362/471 |
| 7,144,135 | B2 | 12/2006 | Martin et al. | 362/294 |
| 7,344,279 | B2 | 3/2008 | Mueller et al. | 362/294 |
| 7,473,011 | B2 | 1/2009 | Wilcox et al. | 362/294 |
| 7,614,769 | B2 * | 11/2009 | Sell | 362/365 |
| 7,661,854 | B1 * | 2/2010 | Yang et al. | 362/373 |
| 7,677,770 | B2 * | 3/2010 | Mazzochette | 362/364 |
| 7,722,227 | B2 * | 5/2010 | Zhang et al. | 362/364 |
| 7,862,214 | B2 * | 1/2011 | Trott et al. | 362/365 |
| 2008/0165535 | A1 | 7/2008 | Mazzochette | 362/294 |
| 2008/0278941 | A1 | 11/2008 | Logan et al. | 362/234 |
| 2008/0278950 | A1 | 11/2008 | Pickard et al. | 362/294 |
| 2009/0086476 | A1 * | 4/2009 | Tickner et al. | 362/231 |
| 2010/0002433 | A1 * | 1/2010 | Liu | 362/235 |
| 2010/0053950 | A1 * | 3/2010 | Higuchi et al. | 362/234 |
| 2010/0127637 | A1 * | 5/2010 | Alexander et al. | 315/294 |
| 2010/0195329 | A1 * | 8/2010 | Inoue et al. | 362/235 |
| 2010/0226139 | A1 * | 9/2010 | Lynch et al. | 362/373 |

OTHER PUBLICATIONS

Progress Lighting Brochure, Dec. 2008 (3 pages).
Photographs of Cooper Lighting LED Lamp Assembly (Figures 1-5), dated at least as early as Mar. 6, 2009 (5 pages).

* cited by examiner

*Primary Examiner* — Jong-Suk (James) Lee
*Assistant Examiner* — David Crowe

(57) ABSTRACT

A unitary die-cast cap for a downlight can includes a base section and a plurality of heat-sink fins. The base section is a plate that includes an interior base-surface, an exterior base-surface, and an exterior wall-surface. The exterior base-surface, which is an opposite surface of the interior base-surface, forms an exterior top-surface of a downlight tubular can. The exterior wall-surface is configured to be positioned in direct attachment to an interior wall-surface of the downlight can. The plurality of heat-sink fins extend from the interior base-surface and form a substantially cylindrical exterior heat-sink wall touching or in close proximity to the interior wall-surface of the downlight can.

18 Claims, 9 Drawing Sheets

RECESSED LED DOWNLIGHT

FIELD OF THE INVENTION

This invention is directed generally to recessed lighting systems, and, more particularly, to a unitary die-cast cap for a recessed LED downlight.

BACKGROUND OF THE INVENTION

In comparison to other types of light fixtures, e.g., incandescent and fluorescent light fixtures, light-emitting diodes ("LEDs") provide numerous advantages. For example, LED-based lighting fixtures (i) dramatically reduce energy consumption based on relatively low wattage, (ii) have a relatively longer life (e.g., 50,000 hours vs. 2,000-5,000 hours for incandescent light fixtures), (iii) provide cool operation (e.g., reduce energy costs by reducing air conditioning loads), (iv) contain no lead or mercury (e.g., eliminate special recycling requirements), and (v) do not have ultraviolet emissions.

However, current LED-based lighting fixtures, such as LED downlights, are plagued by many problems. One problem associated with some current LED downlights is that they lack a heat sink that is integral with the can housing such that the entire LED downlight assembly becomes a heat sink for dissipating heat away from the LEDs. Another problem associated with some current LED downlights is that they fail to provide a removable LED PC board that can be mounted directly to the heat sink for improved thermal management. Yet another problem associated with some current LED downlights is that they fail to provide an integral mounting configuration that can receive a reflector/lens assembly or a trim.

What is needed, therefore, is a cap for a downlight can that addresses the above-stated and other problems.

SUMMARY OF THE INVENTION

In an implementation of the present invention, a unitary die-cast cap for a downlight can includes a base section and a plurality of heat-sink fins. The base section includes an interior base-surface, an exterior base-surface, and an exterior wall-surface. The exterior base-surface, which is an opposite surface of the interior base-surface, is configured to form an exterior top-surface of a downlight can. The exterior wall-surface is configured to be positioned in direct attachment to an interior wall-surface of the downlight can. The plurality of heat-sink fins extend from the interior base-surface and form a substantially cylindrical exterior heat-sink wall touching or in close proximity to the interior wall-surface of the downlight can.

In an alternative implementation of the present invention, a downlight assembly includes a downlight can, a unitary die-cast cap, a LED array, a reflector and lens assembly, and a finishing trim. The downlight can has a tubular can wall. The unitary die-cast cap is mounted inside the downlight can and includes a base section, a plurality of heat-sink fins, and an interior plate. The base section has an exterior base-surface forming an exterior top-surface of the downlight can and an exterior-wall for direct contact attachment to the tubular can wall. The plurality of heat-sink fins extend from the base section and form a substantially cylindrical exterior heat-sink wall touching or in close proximity to the tubular can wall. The heat-sink fins include at least one tall heat-sink fin and at least one short heat-sink fin. The interior plate is surrounded by the plurality of heat-sink fins and is offset from and generally parallel to the base section A plurality of spring retainers are mounted to the interior plate of the die-cast cap. The LED array and the reflector and lens assembly are each mounted on the interior plate of the die-cast cap. The finishing trim is mounted to the spring retainers via a plurality of coil springs.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
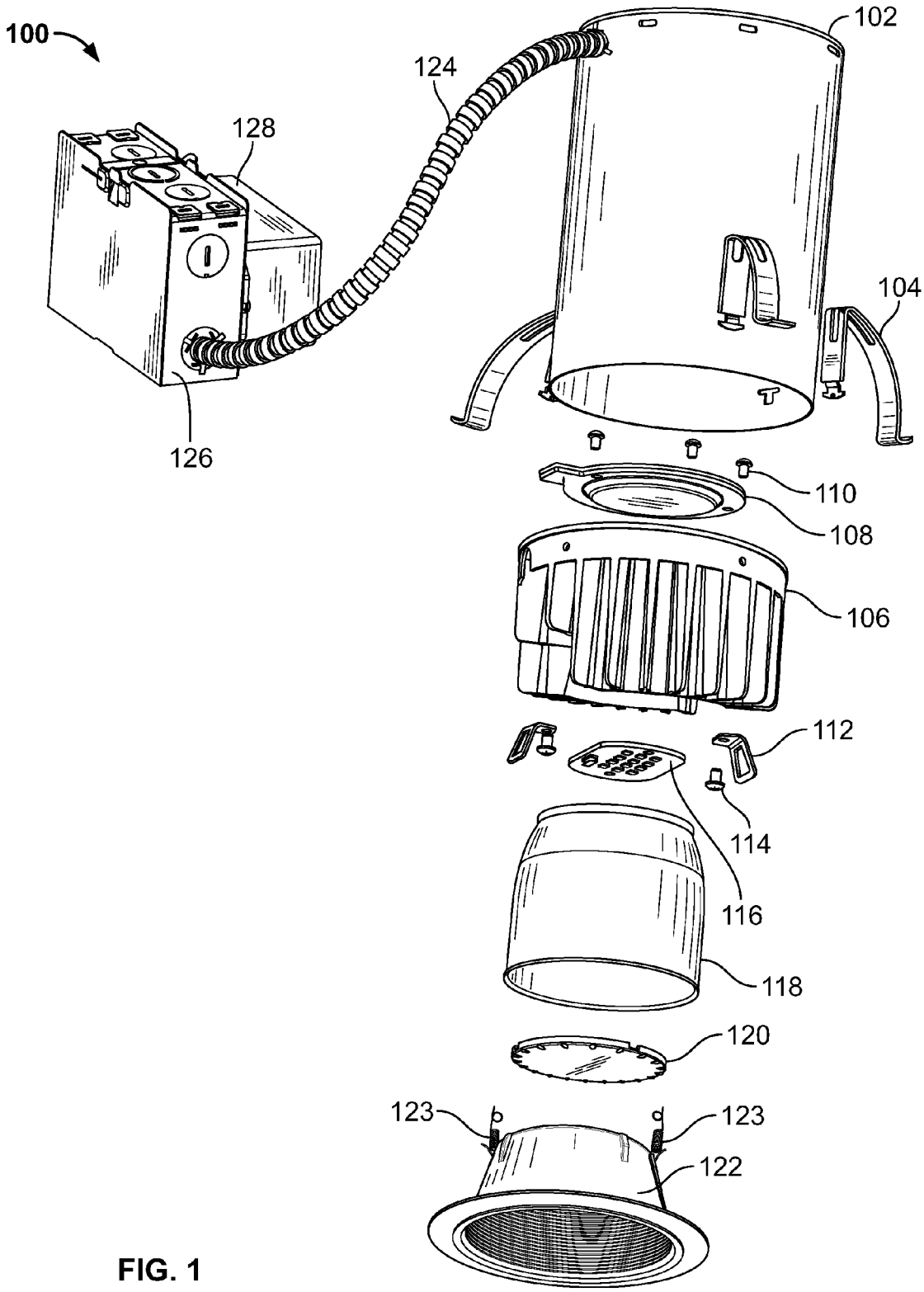
FIG. 1 is an exploded view of an assembly for a recessed LED downlight for remodel style installations.
Figure 2A:
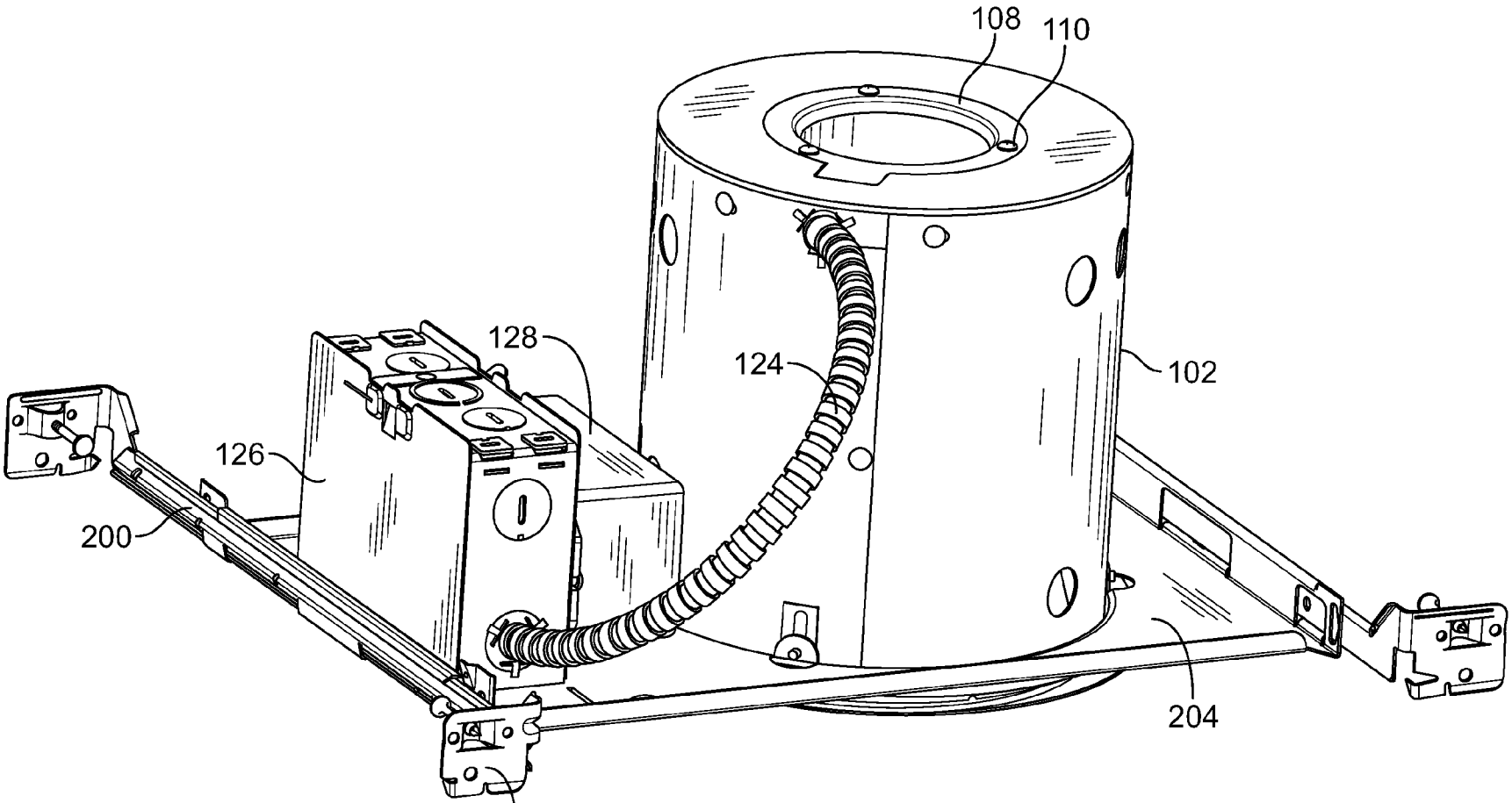
FIG. 2A is a top perspective view illustrating the downlight assembly of FIG. 1 in assembled form for new constructions style installations.

Referring to FIG. 1, a downlight fixture assembly 100 for a recessed light includes a downlight can 102 having three support members 104 positioned generally symmetrically on an exterior surface of the downlight can 102. The can 102 is an open-ended hollow tubular wall (shown in cylindrical form), similar to standard downlight cans, having an exterior wall-surface and an interior wall-surface. A unitary die-cast cap 106, which is designed to fit inside the downlight can 102, includes a removable cutout plate 108 mounted generally flush with an exterior base-surface of the cap 106 via a plurality of cutout screws 110 (FIG. 2A).

The downlight assembly 100 is advantageous at least because it is suitable for use in both insulated and non-insulated ceilings. The downlight assembly 100 is also advantageous because it provides a component approach in which components of the downlight assembly 100 can be replaced on an individual basis. For example, the downlight assembly 100 provides easy changing of optics, such as a diffuser, reflector, finishing trim, etc. In contrast, typical current downlight assemblies provide an all-in-one approach in which replacing a specific component requires replacing numerous components, if not the entire downlight assembly.

Figure 3A:
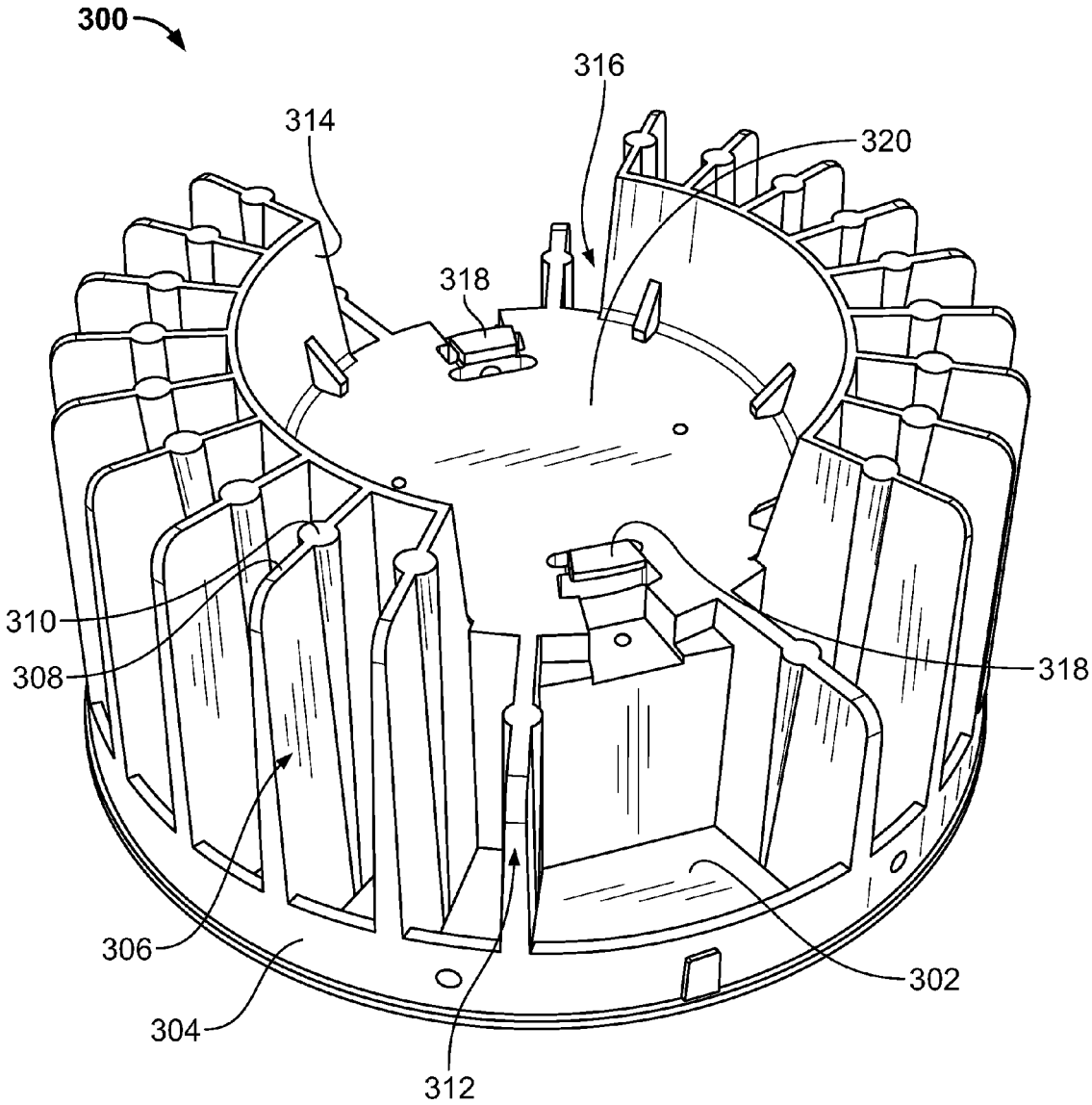
FIG. 3A is a bottom perspective view of a unitary die-cast cap for a downlight can.

Two coil spring receivers (a.k.a., trim hanger loops) 112 are attached to an interior-space surface (e.g., interior-space surface 320 illustrated in FIG. 3A) of the cap 106 via a respective receiver screw 114. Any other type of fasteners can be used instead of or in addition to the cutout screws 110 and the receiver screw 114. Each of the coil spring receivers 112 includes a loop-shaped bracket configured to receive a first end of a standard coil spring 123, wherein a second end of the coil spring is attached to a standard finishing trim 122.

Also mounted on the interior-space surface of the cap 106 is a LED array 116, which includes a printed circuit (PC) board. Mounting the LED light array 116 directly to the cap 106 provides greatly enhanced thermal dissipation. The PC board of the LED light array 116 is mounted to the interior-space surface of the cap 106 such that the LED light array 116 can be easily replaced. Alternatively to mounting the LED light array 116 using screws similar to the cutout screws 110 and/or receiver screw 114, the LED light array 116 can be fastened via surface mount push-in connectors that can facilitate easy and quick removal/installation of the PC board.

According to one exemplary embodiment, the LED light array 116 incorporates latest generation of Nichia high lumen 1-watt LEDs. For example, the total luminaire wattage can be 14 Watts, wherein the ranges are between 13.4 Watts and 14.2 Watts based on forward voltage binning. The LED light array 116 can include color temperatures for a variety of residential and commercial applications, e.g., 3000K, 3500K, 4100K.

The downlight assembly 100 further includes a reflector 118, to which a lens 120 is mounted, forming a reflector and lens assembly. The reflector 118 is mounted directly to the cap 106 via a bayonet-type surface of the reflector 118, and the finishing trim 122 is mounted directly to the can 102. The reflector 118 and the lens 120 are specifically designed to provide a desired light distribution while masking the individual LEDs and simulating the appearance from below the ceiling of familiar incandescent BR or PAR lamps with an attractive frosted lens. In one exemplary embodiment, the light distribution from the reflector and lens assembly replicates the performance of a 65 W BR30, one of the most popular incandescent lamps currently being used in recessed downlights. The finishing trim 122 can be selected from a plurality of standard trims, e.g., baffle trims, cone trims, lensed trims, and decorative trims, which are commonly available for use with both incandescent and compact fluorescent light (CFL) housings.

A conduit 124 couples a wiring box 126 to the can 102, and a LED driver 128 is mounted to the wiring box 126. Optionally, the conduit 124 can be a metal conduit or a non-metallic cable. The LED driver 128 is mounted separate from the LED array 116. Thus, the LED driver 128 and the PC board of the LED array 116 can be serviced independently, wherein each one can be individually replaced without having to replace the other one. In contrast, current LED fixtures require replacement of the entire LED light engine regardless of whether only the driver or only the PC board requires replacement. In other embodiments, the LED driver 128 or an auxiliary controller circuit can be installed into a cavity in a top compartment of the casting 106 (e.g., interior electrical access area 324 described below in reference to FIG. 3B).

According to one exemplary embodiment, the LED driver 128 receives constant current, is a universal voltage driver, and has input voltages from 120 Volts to 277 Volts (60 Hertz). The exemplary LED driver 128 is a high efficiency driver, having a power factor greater than 0.9 at 120 Volts. The LED driver 128 can also be dimmable using, for example, standard wall-box dimmers. The LED driver 128 is compliant for electromagnetic interference/radio frequency interference (EMI/RFI) with Part 15 of the Federal Communications Commission (FCC) rules and regulations (i.e., Class B at 120 Volts and Class A at 277 Volts).

Figure 2B:
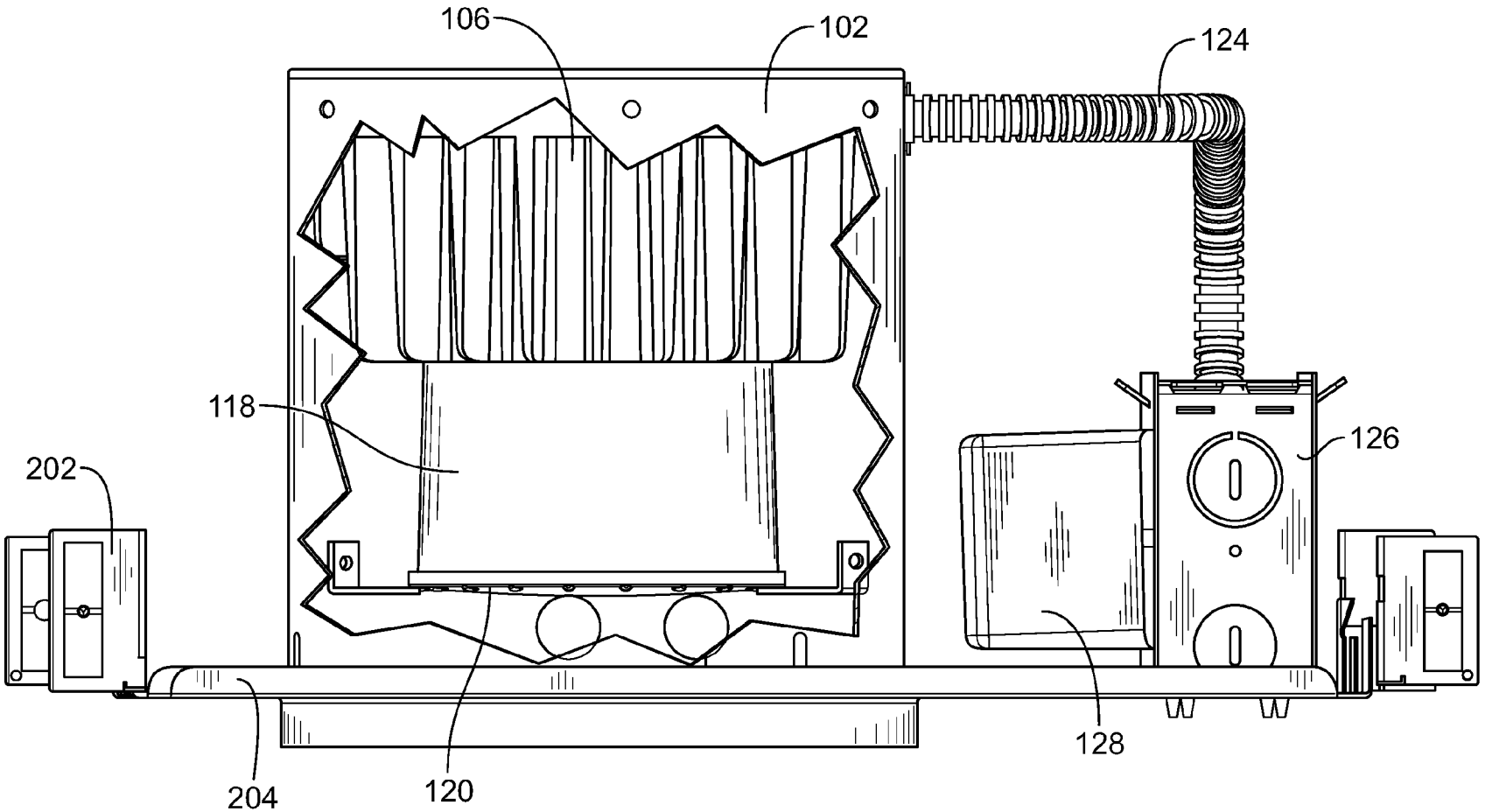
FIG. 2B is a side view with partial cutouts illustrating the downlight assembly of FIG. 2A.
Figure 2C:
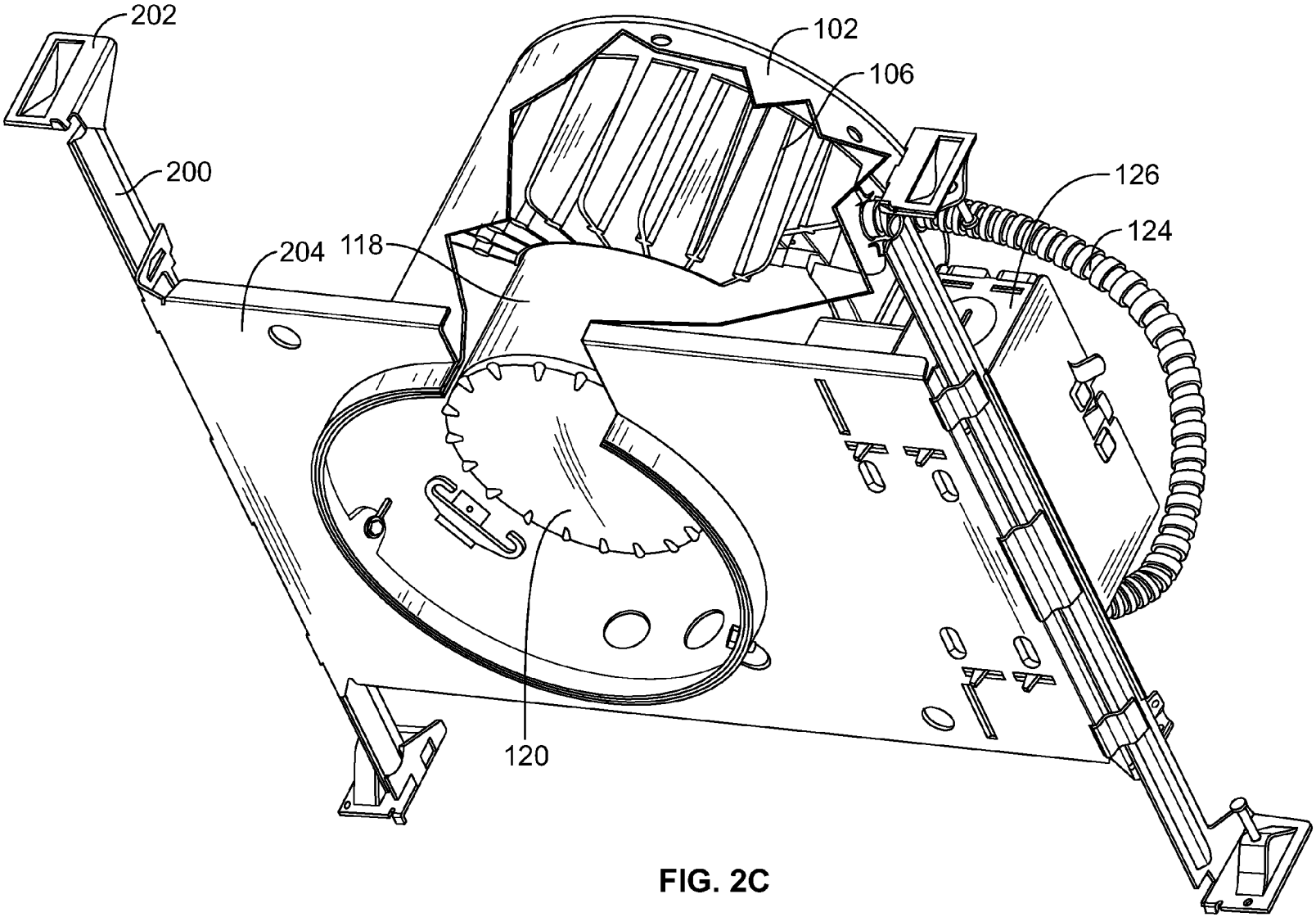
FIG. 2C is a bottom perspective view with partial cutouts illustrating the downlight assembly of FIG. 2A.

Referring to FIGS. 2A-2C, each one of a pair of opposite bar hangers 200 includes a pair of bar hanger feet 202 for mounting a plaster frame 204 between structural joists in a typical ceiling. The bar hangers 200 are adjustable to fit between the joists and the bar hanger feet 202 are contoured to easily align with a bottom of a respective joist. The bar hanger feet 202 are fixed to the joists using nails or other suitable fasteners. The downlight can 102 and the wiring box are mounted directly to the plaster frame 204.

As illustrated more clearly in FIG. 2A, the removable cutout plate 108 is mounted generally flush with an exterior base-surface of the cap 102. The cutout plate 108 is removable to facilitate factory assembly and wiring of the fixture and to provide electrical access to components that may be mounted inside the cavity of the cap 106, e.g., an auxiliary dimming or color control circuit.

As illustrated more clearly in FIGS. 2B and 2C, the cap 106 is mounted inside the can 102 such that an exterior wall-surface (e.g., exterior wall-surface 304 in FIG. 3A) of the cap 106 is in direct contact with or in close proximity to the interior wall-surface of the can 102. Thus, the cap 106 is mounted inside the can 102 such that the exterior wall-surface of the cap 106 is in direct attachment to the interior wall-surface of the cylindrical wall of the can 102. The direct attachment of the cap 106 to the can 102 improves heat dissipation away from the LED array 116.

Referring to FIGS. 3A-3E, a unitary aluminum die-cast cap 300 includes a plurality of features in accordance with an exemplary embodiment. As more clearly illustrated in FIG. 3A, the cap 300 includes a base section having an interior base-surface 302 and an exterior wall-surface 304 extending around a periphery of the interior base-surface 302. Coextensive in part with the exterior wall-surface 304 is a plurality of heat-sink fins 306, 312, which extend generally perpendicularly from the interior base-surface 302. The heat-sink fins 306, 312 form a substantially cylindrical exterior heat-sink wall that is in contact with or in close proximity to the interior wall-surface of the can 102.

The heat-sink fins 306, 312 include a first plurality of heat-sink fins 306 having a greater height (i.e., tall heat-sink fins) than a second plurality of heat-sink fins 312 (i.e., short heat-sink fins). The height is measured as the distance extending perpendicularly away from the interior base-surface 302 towards an interior space 316 in which the LED light array 116 is mounted.

The heat-sink fins 306, 312 are generally shaped such that they include a generally rectangular cross-sectional area 308 and a generally cylindrical cross-sectional area 310. The cylindrical cross-sectional area 310 is generally centrally located along the rectangular cross-sectional area 308.

The fins of the first plurality of heat-sink fins 306 are connected to each other via a substantially cylindrical interior heat-sink wall 314. The interior heat-sink wall 314 forms the interior space 316.

In addition to the interior heat-sink wall 314, the interior space 316 includes a plurality of reflector retainers 318 and is further defined by an interior-space surface 320, which is generally flush with an end surface of the second plurality of heat-sink fins 312. In other words, the interior-space surface 320 is generally flush with the highest point of the second plurality of heat-sink fins 312.

Two reflector retainers 318 are integral with the interior-space surface 320 of the cap 300. The reflector retainers 318 are generally L-shaped and have a raised portion extending away from the interior-space surface 320. In general, the reflector retainers are configured to receive an attachment surface of the reflector 118 for mounting the reflector and lens assembly 118, 120 to the cap 300. For example, the reflector 118 is mounted to the reflector retainers 318 by rotating ¼ turn clockwise such that the attachment surface of the reflector 118 is captured by the reflector retainers 318. To remove the reflector 118, the reflector 118 is rotated ¼ turn counterclockwise to release the captured attachment surface from the reflector retainers 318. Furthermore, the reflector retainers 318 are centrally positioned between two short heat-sink fins 312, wherein the shorter height of the heat-sink fins 312 is designed to accommodate the reflector retainers 318 (and the spring receivers 112 shown in FIG. 1).

Figure 3B:
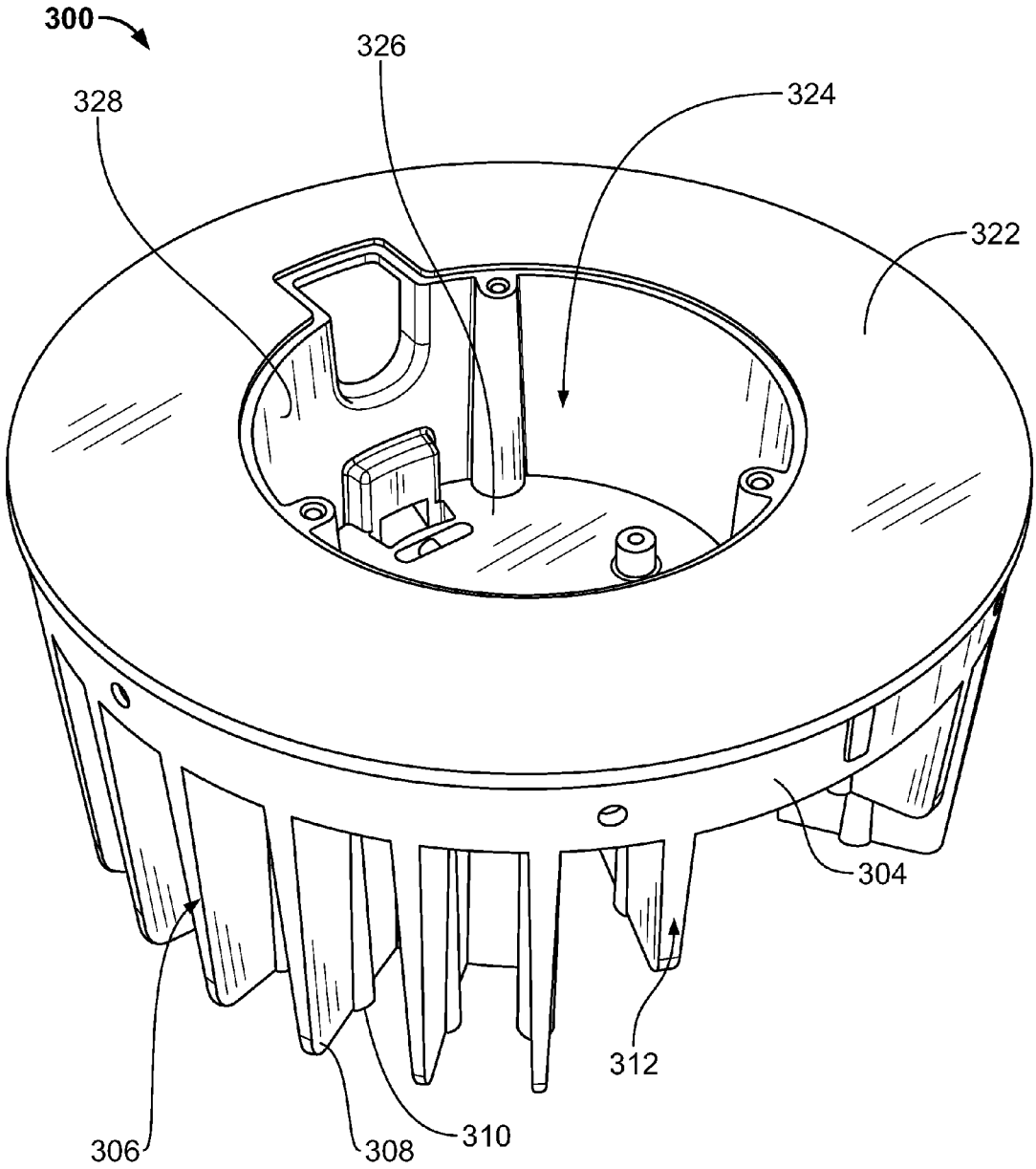
FIG. 3B is a top perspective view of the unitary die-cast cap of FIG. 3A.
Figure 3C:
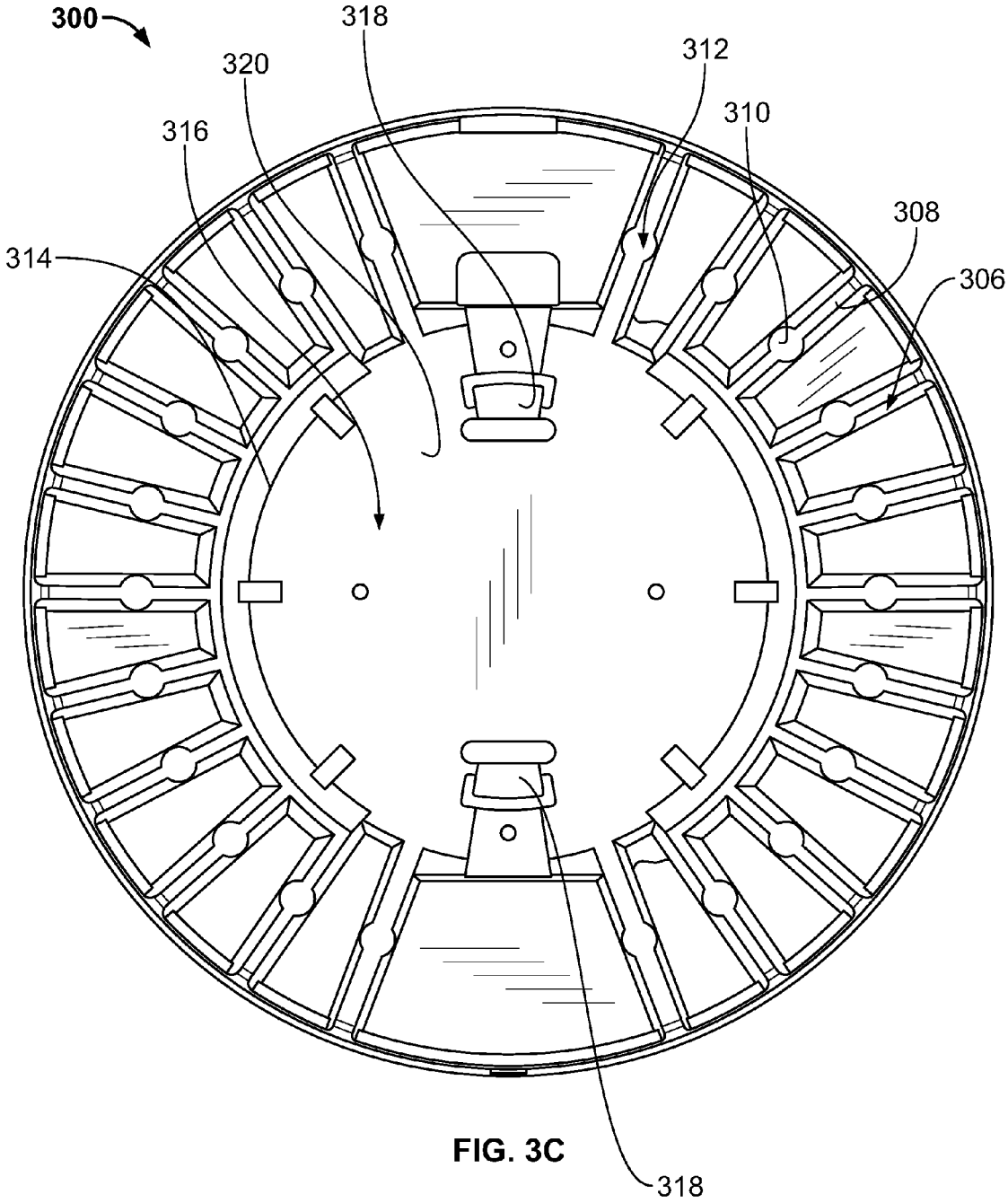
FIG. 3C is a bottom view of the unitary die-cast cap of FIG. 3A.
Figure 3D:
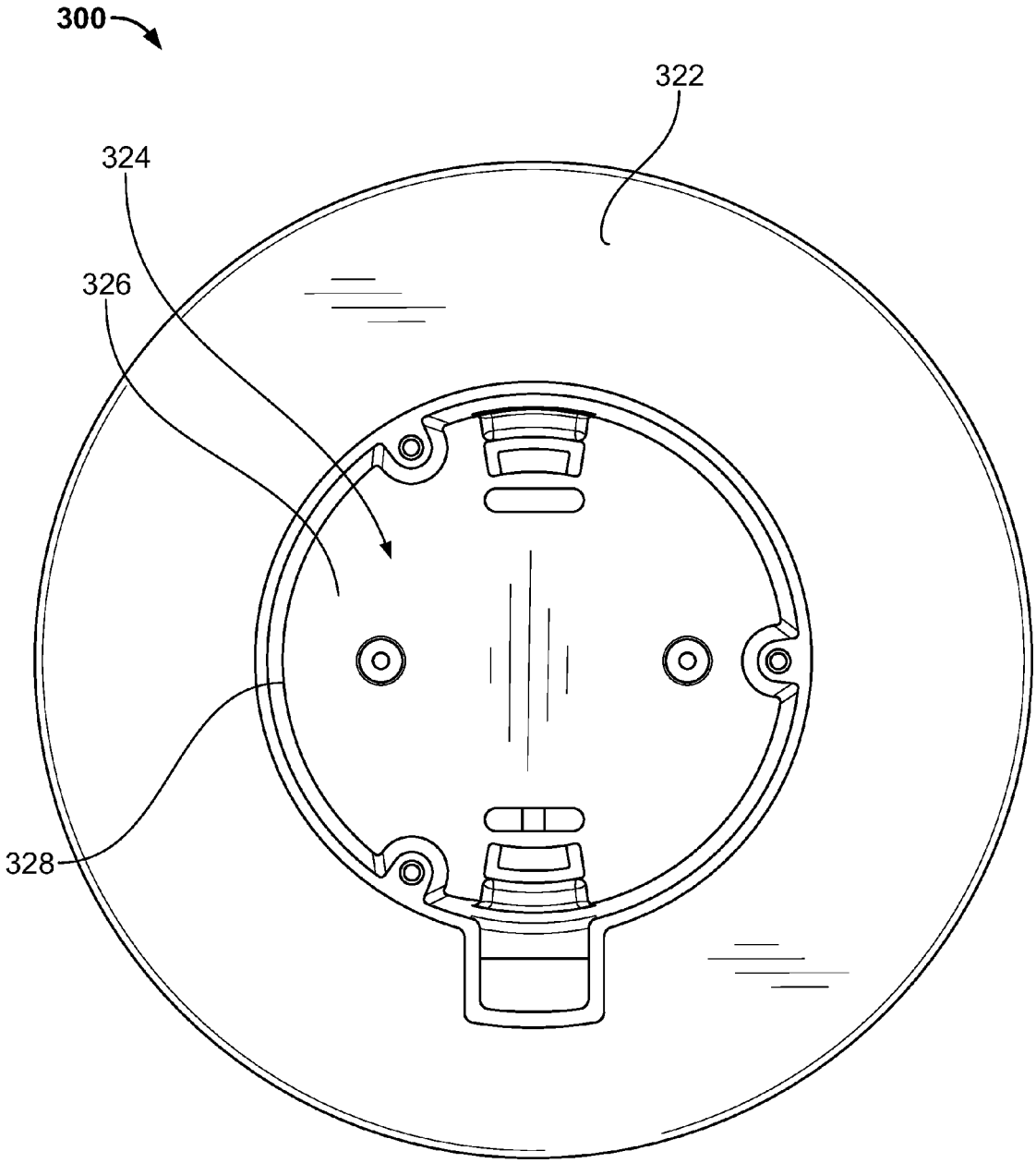
FIG. 3D is a top view of the unitary die-cast cap of FIG. 3A.
Figure 3E:
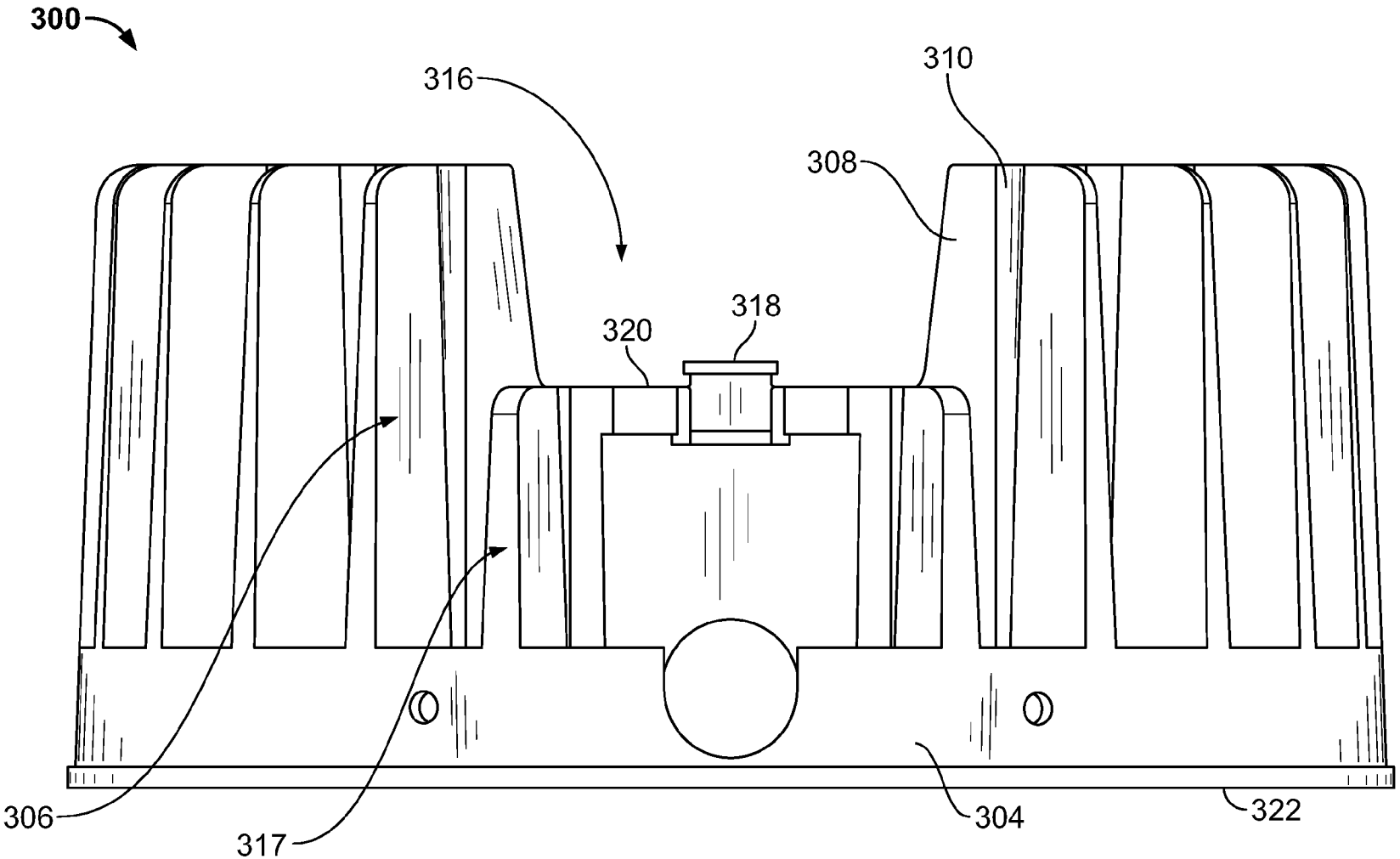
FIG. 3E is a side view of the unitary die-cast cap of FIG. 3A.

As illustrated more clearly in FIG. 3B, the cap 300 further includes an exterior base-surface 322 that forms an exterior top-surface of the can 102 (which, being a hollow can, lacks a top surface or a bottom surface) when the cap 300 and the can 102 are mounted to each other. The exterior base-surface 322 is an opposite surface of the interior base-surface 302.

The cap 300 further includes an interior electrical access area 324, which is generally defined by a bottom access-surface 326 and an interior access wall 328. The interior access wall 328 is formed at an innermost edge of the heat-sink fins 306, 312 and connects all the heat-sink fins 306, 312. Alternatively, the interior access wall 328 connects only some of the heat-sink fins 306, 312.

The interior-space surface 320 (best illustrated in FIG. 3A) and the bottom access-surface 326 (best illustrated in FIG. 3B) generally define an interior plate that is located inward of and surrounded by the plurality of heat-sink fins 306, 312. The interior plate is offset from and parallel to the exterior base-surface 322. The bottom access-surface 326 is an opposite surface of the interior-space surface 320 and is oriented in the same direction as the exterior base-surface 322. Furthermore, the bottom access-surface 326 is configured to receive one or more fasteners for mounting, for example, the LED light array 116 to the interior-space surface 320.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A downlight assembly, comprising:

a downlight can having a tubular can wall;

a unitary die-cast cap mounted inside the downlight can and having a base section including an interior base-surface, an exterior base-surface configured to form an exterior top-surface of the downlight can, the exterior base-surface being an opposite surface of the interior base-surface, and an exterior wall-surface for direct contact attachment to an interior wall-surface of the tubular can wall, a plurality of heat-sink fins extending from the interior base-surface and forming a substantially cylindrical exterior heat-sink wall touching or in close proximity to the interior wall-surface of the tubular can wall, the plurality of heat-sink fins including tall fins and short fins, the tall fins having a greater height than the short fins, the height being measured as the distance extending perpendicularly away from the interior base-surface towards an interior space, the tall fins including a first set of tall fins and a second set of tall fins, the short fins including a first set of short fins and a second set of short fins, the first set of tall fins being separated from the second set of tall fins by the first set of short fins and the second set of short fins, the first set of short fins being separated from the second set of short fins by the first set of tall fins and the second set of tall fins, and an interior plate surrounded by the plurality of heat-sink fins;

a plurality of spring retainers mounted to the interior plate of the die-cast cap;

a LED array mounted on the interior plate of the die-cast cap in the interior space;

a reflector and lens assembly mounted to the interior plate of the die-cast cap; and a finishing trim mounted to the spring retainers via a plurality of coil springs.

2. The downlight assembly of claim 1, wherein at least some of the plurality of heat-sink fins are connected to each other via a substantially cylindrical interior heat-sink wall, the interior heat-sink wall forming the interior space in which the LED array is mounted.

3. The downlight assembly of claim 1, wherein the interior space is further configured to receive the reflector and lens assembly by way of bayonet-type insertion.

4. The downlight assembly of claim 3, wherein the interior space includes a plurality of integral reflector retainers for mounting the reflector and lens assembly.

5. The downlight assembly of claim 1, wherein the interior plate is a removable cutout plate that is mounted generally flush with the exterior base-surface, the interior plate being removable to provide electrical access to components mounted inside the unitary die-cast cap.

6. The downlight assembly of claim 1, wherein the interior plate has a first surface for receiving the LED array and a second surface for receiving one or more fasteners, the second surface being an opposite surface of the first surface and oriented in the same direction as the exterior base-surface of the base section.

7. The downlight assembly of claim 6, wherein the second surface of the interior plate is a bottom access-surface of an interior electrical access area.

8. The downlight assembly of claim 7, wherein the interior electrical access area includes an interior access wall formed at an innermost edge of the plurality of heat-sink fins, the interior access wall connecting at least some of the plurality of heat-sink fins.

9. The downlight assembly of claim 1, wherein the plurality of heat-sink fins includes a generally cylindrical cross-sectional area and a generally rectangular cross-sectional area, the cylindrical cross-sectional area being generally centrally located along the rectangular cross-sectional area.

10. A downlight assembly, comprising:

a downlight can having a tubular can wall;

a unitary die-cast cap mounted inside the downlight can, the die-cast cap including a base section having an exterior base-surface forming an exterior top-surface of the downlight can, the base section further having an exterior-wall surface for direct contact attachment to the tubular can wall, a plurality of heat-sink fins extending from the base section and forming a substantially cylindrical exterior heat-sink wall in close proximity to or in direct contact with the tubular can wall, the plurality of heat-sink fins including one or more tall heat-sink fins and one or more short heat-sink fins, and an interior plate surrounded by the plurality of heat-sink fins, the interior plate being offset from and generally parallel to the exterior base-surface;

a plurality of spring retainers mounted to the interior plate of the die-cast cap;

a LED array mounted on the interior plate of the die-cast cap;

a reflector and lens assembly mounted to the interior plate of the die-cast cap; and a finishing trim mounted to the spring retainers via a plurality of coil springs.

11. The downlight assembly of claim 10, wherein the plurality of heat-sink fins are in contact with the can wall.

12. The downlight assembly of claim 10, wherein the reflector and lens assembly provides a desired light distribution while masking the individual LEDs and providing the appearance of a specific incandescent BR or PAR lamp with a particular frosted lens.

13. The downlight assembly of claim 10, wherein the LED array includes a PC board, the PC board being mounted directly to the interior plate of the die-cast cap.

14. The downlight assembly of claim 10, wherein the finishing trim is selected from a plurality of standard trims that are available for use with both incandescent and compact fluorescent light housings.

15. The downlight assembly of claim 10, wherein the die-cast cap further includes a removable cutout plate for providing electrical access to a space within the die-cast cap, the cutout plate being mounted generally flush with the exterior base-surface.

16. The downlight assembly of claim 10, wherein the reflector and lens assembly is mounted to the interior plate via a plurality of reflector retainers, the reflector retainers being integrally formed with the die-cast cap.

17. The downlight assembly of claim 10, wherein each of the spring retainers is positioned proximate to a corresponding short heat-sink fin.

18. The downlight assembly of claim 17, wherein each of the spring retainers is a loop-shaped bracket and is fastened to the interior plate.

* * * * *